US005368456A

United States Patent [19]

Hirayama et al.

[11] Patent Number: 5,368,456

[45] Date of Patent: Nov. 29, 1994

[54] FLUID COMPRESSOR WITH BEARING MEANS DISPOSED INSIDE A ROTARY ROD

[75] Inventors: Takuya Hirayama; Toshiya Yajima, both of Kanagawa, Japan

[73] Assignee: Kabushiki Kaisha Toshiba, Kawasaki, Japan

[21] Appl. No.: 36,730

[22] Filed: Mar. 25, 1993

[30] Foreign Application Priority Data

Mar. 26, 1992 [JP] Japan ..... 4-068442

[51] Int. Cl.[5] ..... F04C 2/00

[52] U.S. Cl. ..... 418/220; 418/164; 418/188; 417/356

[58] Field of Search ..... 418/220, 161, 164, 188; 417/355, 356

[56] References Cited

U.S. PATENT DOCUMENTS

| | | | |
|---|---|---|---|
| 2,401,189 | 5/1946 | Quiroz | 103/117 |
| 4,871,304 | 10/1989 | Iida et al. | 418/220 |
| 5,062,778 | 11/1991 | Hattori et al. | 418/220 |
| 5,174,737 | 12/1992 | Sakata et al. | 418/220 |

FOREIGN PATENT DOCUMENTS

| | | | |
|---|---|---|---|
| 4001493 | 1/1992 | Japan | 418/220 |

*Primary Examiner*—Richard A. Beatsch
*Assistant Examiner*—Charles G. Freay
*Attorney, Agent, or Firm*—Foley & Lardner

[57] ABSTRACT

A fluid compressor with bearing means disposed inside a rotary member includes a cylinder having an inner circumferential surface therein; supporting means for rotatably supporting both ends of the cylinder; a rotary member arranged in the cylinder so as to extend in the axial direction of the cylinder and be eccentric thereto, the rotary member having a spiral groove formed on an outer circumferential surface thereof, the spiral groove having pitches gradually narrowing with a distance from a suction-side end to a discharge-side end of the cylinder; a spiral blade fitted in the spiral groove so as to be slidable in the radial direction of the rotary member; and drive unit for rotating the cylinder and the rotary member, wherein the supporting member is characterized in that the supporting member is extended inwardly the rotary member from a base portion fixed to the case.

3 Claims, 7 Drawing Sheets

FLUID COMPRESSOR WITH BEARING MEANS DISPOSED INSIDE A ROTARY ROD

BACKGROUND OF THE INVENTION

1. Field of the Invention

The present invention relates to a spiral type fluid compressor which is, for instance, suitable for compressing a refrigerant of a cooling cycle.

2. Description of the Prior Art

As general compressors in the conventional practice, there are available a reciprocating type compressor, rotary type compressor, and a spiral type compressor where a refrigerant fed into an operation chamber from a suction end side of a cylinder is transferred successively into a discharge end of the operation chamber while being compressed, so as to be discharged into an external portion.

With reference to FIG. 1, the spiral type compressor comprises (1) a cylinder 105 rotated by drive means consisting of a stator 101 and a rotor 103 and (2) a rotary rod 109 which is disposed eccentrically relative to an axis of the cylinder 105 by a distance e and which is rotatable relative to the cylinder 105 through an Oldham mechanism 107. Spindle portions 111, 111 of the rotary rod 109 are freely rotatably supported by bearing portions 113, 113 provided at both ends of the rotation rod 109. A pair of spiral grooves 115, 115 is formed on an outer circumferential surface of the rotary rod 109. The pitches of the groove 115 are gradually reduced with a distance toward the both ends of the rotary rod. A spiral blade 117 is supported in a manner that the spiral blade 117 is freely movable in the radial direction. The outer circumferential surface of the spiral blade 117 is in contact with an inner circumferential surface of the cylinder 105 so that the spiral blade 117 rotates together with the rotary rod 109. The rotary rod 109 rotates eccentrically in a manner that a part of the outer circumferential surface of the rotary rod 109 is in linear contact with the inner circumferential surface of the cylinder 105, so that the spiral blade 117 moves radially relative to the spiral grooves 115. Thereby, there are formed a plurality of operation chambers 119 along an axial direction. With reference to FIG. 2, a volume of the operation chamber 119 is determined by a size of pitch P of the spiral blade 111 supporting the spiral blade 117. The volume of the operation chamber 119 formed by the spiral blades 117 becomes gradually smaller from a central portion toward both ends of the rotary rod, whereby the refrigerant fed to the operation chamber 119 from a suction pipe 121 through a suction hole 123 (FIG. 1) is successively transferred toward both ends so as to be gradually compressed and discharged finally to outside.

The refrigerant is compressed while being transferred from the central operational chamber 119 toward the right- and left-side operational chamber 119, so as to be discharged outside. Then, with reference to FIG. 3, there is caused load forces F, F in the vicinity of the both ends of the rotary rod 109 because a gaseous pressure thereof is high there. The force F is a load force caused by the compression of the gas.

Now, the gas load force F is received by the bearing portion 113. However, a supporting area a of the bearing portion 113 is located very far from the load point of the gas load force F. Moreover, when there is disposed the spiral oil pump 125 within the supporting area a shown in FIG. 3, the actual supporting area becomes a portion indicated with b in FIG. 3, which is about a half of the area a. Thus, the supporting area b is further away from the load point of the gas load force F. Thereby, the rotary rod 109 tends to be deformed as indicated with dotted lines shown in FIG. 3, so that the blade 117 forming the operational chamber 119 tends to be out of contact away from the inner circumferential surface of the cylinder 105 so as to cause a leakage. This leakage caused by the deformation is responsible for a significant decline of performance of the compressor. To alleviate such problem, the supporting shaft 111 of the rotary rod 109 may be made longer thus expanding the supporting area a in order to suppress the degree of deformation and improve the performance. However, the size of the compressor becomes undesirably large so as to cause other problems.

SUMMARY OF THE INVENTION

It is therefore an object of the present invention to provide a fluid compressor housed in a casing, comprising: a cylinder having an inner circumferential surface therein; supporting means for rotatably supporting both ends of the cylinder; rotary means arranged in the cylinder so as to extend in the axial direction of the cylinder and be eccentric thereto, the rotary member having a spiral groove formed on an outer circumferential surface thereof, the spiral groove having pitches gradually narrowing with a distance from a suction-side end to a discharge-side end of the cylinder; a spiral blade fitted in the spiral groove so as to be slidable in the radial direction of the rotary means; and drive means for rotating the cylinder and the rotary means, wherein the supporting means is extended inwardly into the rotary means from a base portion fixed to the casing. The fluid compressor according to the present invention is further characterized in that there is provided a ring-shaped projected member for supporting the cylinder, serving as part of the supporting means, disposed around the cylinder, and the ring-shaped projected member being projected toward the rotary means so that eccentricity of the rotary means against the cylinder remains.

Other features and advantages of the present invention will become apparent from the following description taken in conjunction with the accompanying drawings.

DETAILED DESCRIPTION OF THE PREFERRED EMBODIMENTS

Features of the present invention will become apparent in the course of the following description of exemplary embodiments which are given for illustration of the invention and are not intended to be limiting thereof. Embodiments of the present invention will now be described with reference to the drawings.

Figure 1:
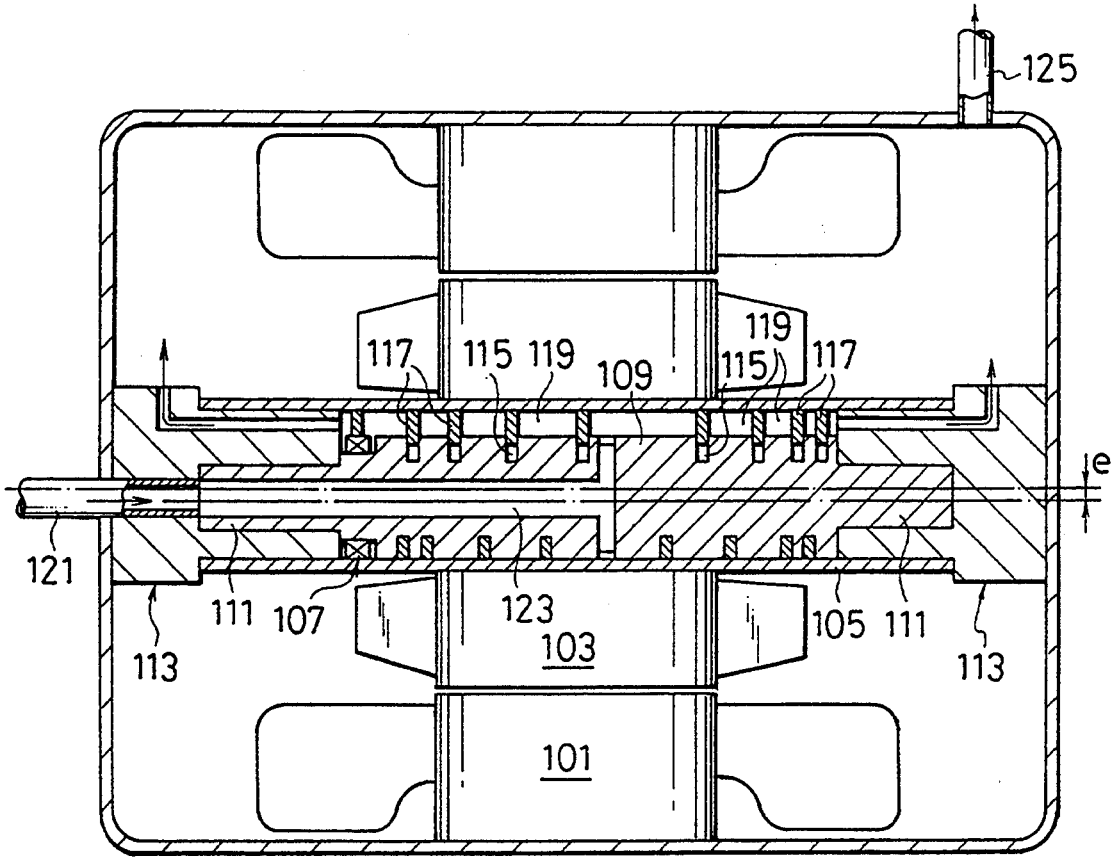
FIG. 1 PRIOR ART
FIG. 1 shows a cross sectional view of the conventional fluid compressor.
Figure 2:
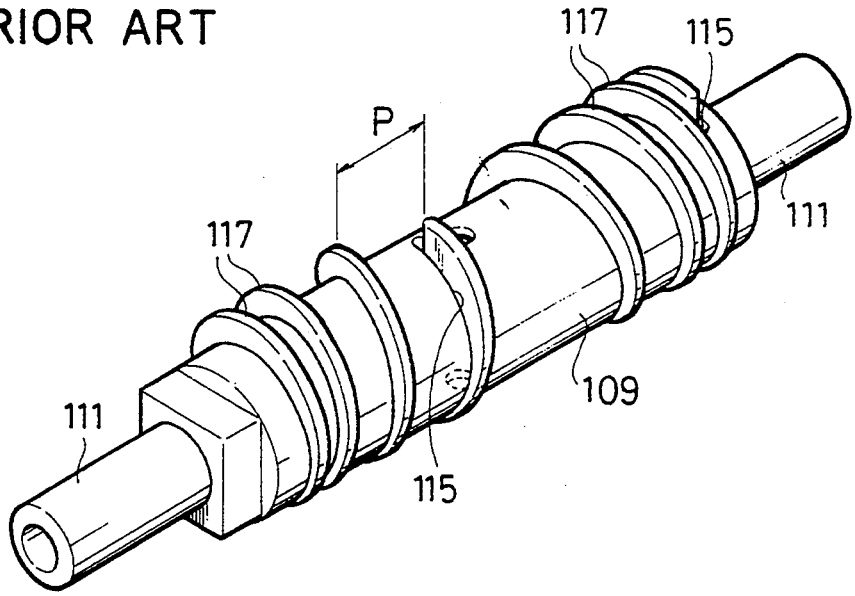
FIG. 2 PRIOR ART
FIG. 2 shows a perspective view of the conventional rotary rod.
Figure 3:
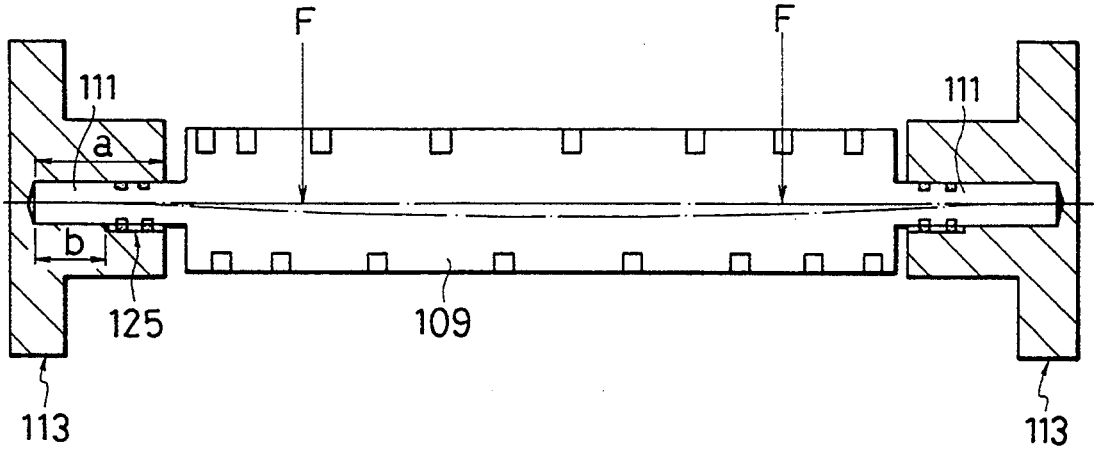
FIG. 3 PRIOR ART
FIG. 3 shows a cross sectional view of the conventional rotary rod.
Figure 4:
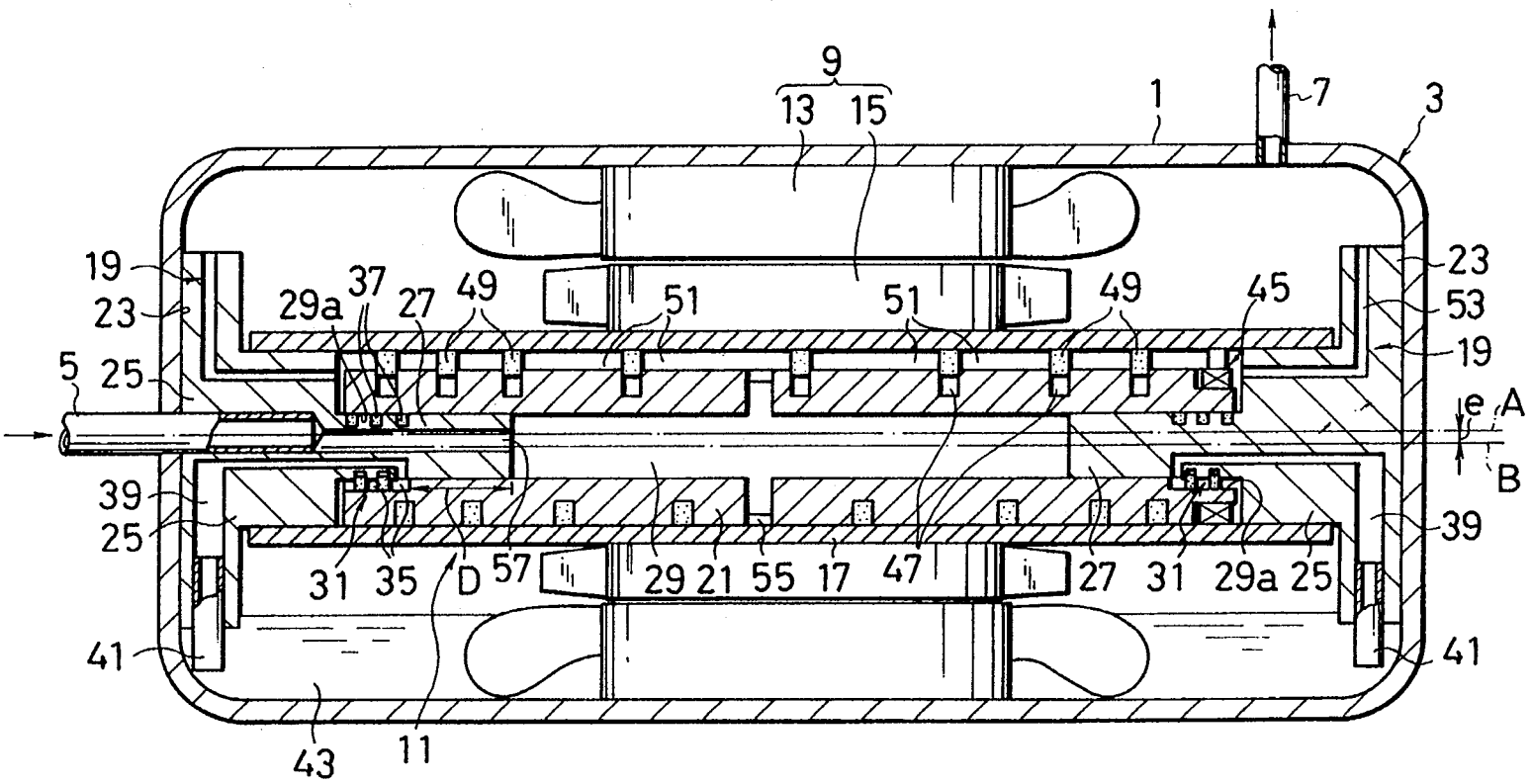
FIG. 4. shows a cross sectional view of a fluid compressor according to the first embodiment of the present invention.

With reference to FIG. 4, the reference numeral 1 denotes a closed case for a closed-type compressor 3 used for a cooling cycle. In an end of the case 1, there is provided a suction pipe 5 for the cooling cycle and in the other end of the case there is provided a discharge pipe 7. In the closed case 1, there are arranged a rotary element 9 serving as drive means and a compressing element 11 serving as compressing means.

The rotary element 9 comprises a stator 13 which is fixed in the inner surface of the closed case 1 and a rotor 15 which is provided inside the stator 13 so that the rotary element 9 functions to provide a rotation power to a cylinder 17.

The compressing element 11 comprises the cylinder 17 supported by bearing portions 19, 19 at both ends and a rotary member 21 disposed inside the cylinder 17.

The bearing portion 19 comprises a base portion 23 fixed to the inner surface of the closed case 1, a first bearing member 25 which is shaft-cylindrically shaped and is extended further inwardly from the base portion 23, and a second bearing member 27 which is shaft-cylindrically shaped and is extended further inwardly from the first bearing member 25. The both ends of the cylinder fixed to the rotor 15 are freely rotatably supported by the first bearing members 25, 25 of the bearing portions 19, 19 and are air-tightly closed.

The rotary member 21 is made of iron-related material or the like, and is formed in a cylindrical shape having a smaller diameter than an inner diameter of the cylinder 17. Inside the rotary member 21, there is provided a main penetrated duct 29 along a central axis line B.

Openings **29*a*, 29*a* at both ends of the main duct 29 are freely rotatably supported by the second bearing member 27 of the bearing portion 19. The central axis line B thereof is disposed eccentrically relative to a central axis A by a distance e, so that a portion of the rotary member 21 which is disposed downwardly due to the eccentricity is in a linear contact with the inner circumferential surface of the cylinder 17**.

There is provided a spiral oil pump 31 in the second bearing member 27 of the bearing portion supporting the rotary member 21, and an inward portion of the second bearing member 27 serves as a supporting region marked D for actually supporting the rotary member 21.

Figure 6:
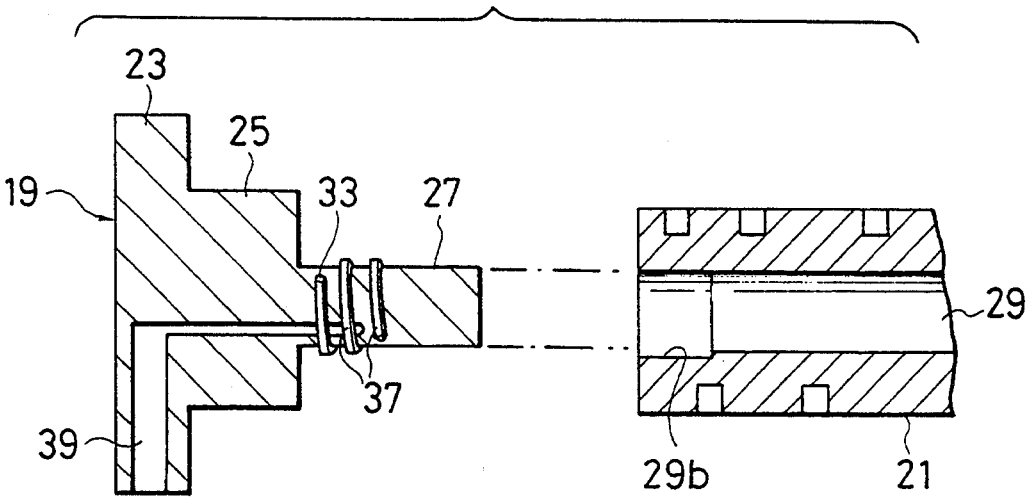
FIG. 6 shows a view of a spiral oil pump mounted to a second bearing member 27.

With reference to FIG. 6, the spiral oil pump 31 is such that in a spiral groove 33 provided in the outer circumference of the second bearing member 27 there is provided a spiral blade 37 which is movable along the groove 33 along the radial direction of the rotary member 21, thus forming an oil pump chamber 35 in an eccentricity opening **29*b* at both ends of the rotary member 21. The oil pump chamber 35 is connected to an oil storage 43 through an oil suction port 39 and an oil supply pipe 41. Thereby, a lubricant which is fed to the oil pump chamber 35 by a spiral movement is supplied through a tribological portion of the compressing element, such as a rotation surface of the bearing portion and a frictional gap between the spiral blade 37 and the spiral groove 33**.

Figure 5:
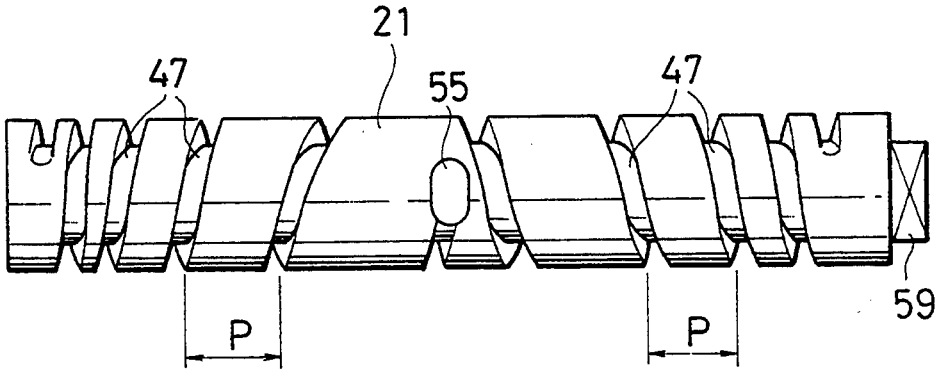
FIG. 5 shows a cross sectional view of a rotary member of the fluid compressor shown in FIG. 4.

With reference to FIG. 5, a pair of spiral grooves 47 extending from the center toward both ends of the rotary member 21 are such that the pitches of the groove 47 are gradually reduced with a distance from the center to the right and left ends of the cylinder 17. The spiral blades 49, 49 made of an elastic material is freely movable along the spiral groove 47 along the radial direction of the rotary member 21.

Therefore, each operational chamber 51 is formed by the spiral blade 49 and the central operational chamber is the suction portion side and has the largest volume. The volume of each operational chamber 51 is designed so that the volume of each operational chamber 51 is gradually reduced toward the right and left ends. The last operational chambers at the both ends are connected to discharge holes 53 which are provided in each bearing portions 19, 19 and are opened to an inside of the closed case 1. The first operational chamber disposed in the center of the rotary member 21 is communicated and connected to the main duct 29 of the rotary member 21 through a circumferentially penetrated passage 55 and the penetration hole 57 provided at one end of the bearing portion 19. Thereby, the refrigerant which is sucked into the cylinder 17 from the suction pipe 5 is continuously introduced to the first operational chamber 51.

Figure 7:
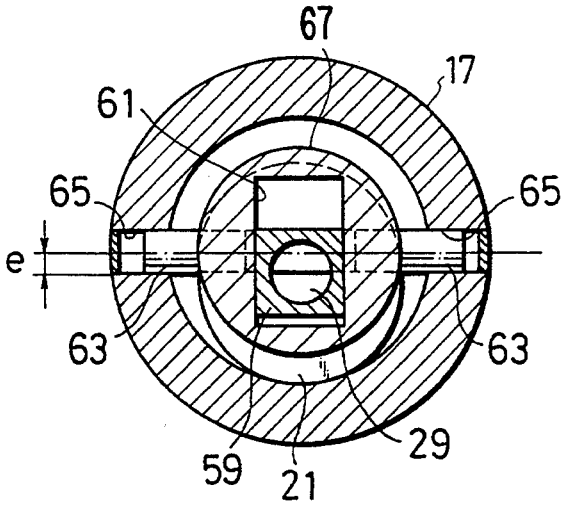
FIG. 7 shows a cross sectional view showing an Oldham mechanism.

In the Oldham mechanism 45, there is provided a square pillar portion 59, on a right end side of the rotary member 21, whose cross section is a square-like and which functions as a power transmitting face to transmit a rotary power from the cylinder side through an Oldham ring 67. With reference to FIG. 7, the square pillar portion 59 is supported by a square-shaped longitudinal hole provided in the Oldham ring 67 with a space for idling therebetween, so that the square pillar portion 59 is slidable in an idling range. Moreover, on the outer circumferential surface of the Oldham ring 67, one end portion of a pair of transmission pins 63, 63 is slidably supported in a radial direction which is vertical to the longitudinal direction of the longitudinal hole 61. Another end portion of the pins 63, 63 is supported and fixed by a through hole 65 disposed in a circumferential wall of the cylinder 17. Thereby, the rotary member 21 can remain unforcibly joined such that the rotary member 21 is positioned eccentrically relative to the cylinder 17 and the torque of the cylinder 17 is transmitted to the rotary member 21 via the Oldham ring.

Thus, the cylinder 17 and the rotor 15 rotate together by the operation of the electrical element 9, so that the rotary member 21 rotates eccentrically relative to the cylinder through the Oldham mechanism 45. Then, there is caused a relative speed between the outer circumferential surface of the rotary member 21 and the inner circumferential surface of the cylinder disposed counter to the rotary member surface, so that the rotary member 21 rotates inside the cylinder 17 while they are in partial contact to each other and the rotary member 21 revolves relative to the cylinder 17.

Next, an operation of the fluid compressor thus structured will be described.

First of all, when the electrical element 9 is energized, the rotor 15 rotates and the cylinder 17 together with the rotor 15 rotates. When the cylinder 17 rotates, the rotary member 21 rotates together with the cylinder 17 through the Oldham mechanism 45. The rotary member 21 revolves relative to the cylinder 17. As a result, fluid such as the refrigerant fed to the operational chamber 51 in the central portion is sequentially transferred toward the right and left ends of the operational chamber 51 to be compressed along the rotation of the rotary member 21, so as to be finally discharged to the outside from the discharge pipe 7.

Figure 8:
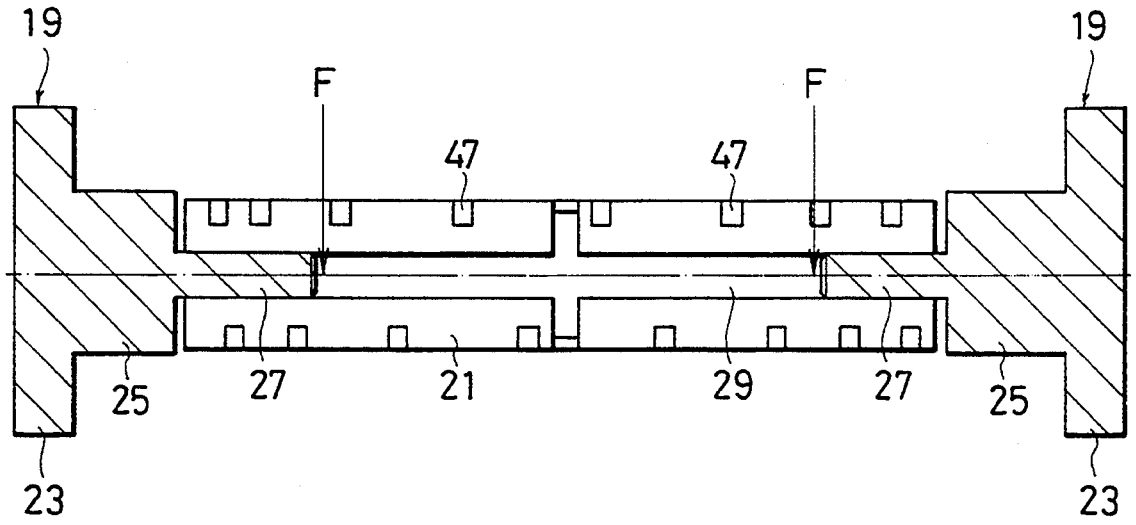
FIG. 8 shows a cross sectional view of a rotary member of the fluid compressor according to the present invention.

With reference to FIG. 8, in this operation, gas load forces F, F generated at both sides of the rotary member 21 are received by the second bearing members 27 which are located in the vicinity of the load force F, so that deformation of the rotary member 21 can be minimized. As a result, the optimum compression state is obtained at the operational chamber 51 without causing leakage therefrom.

Figure 9:
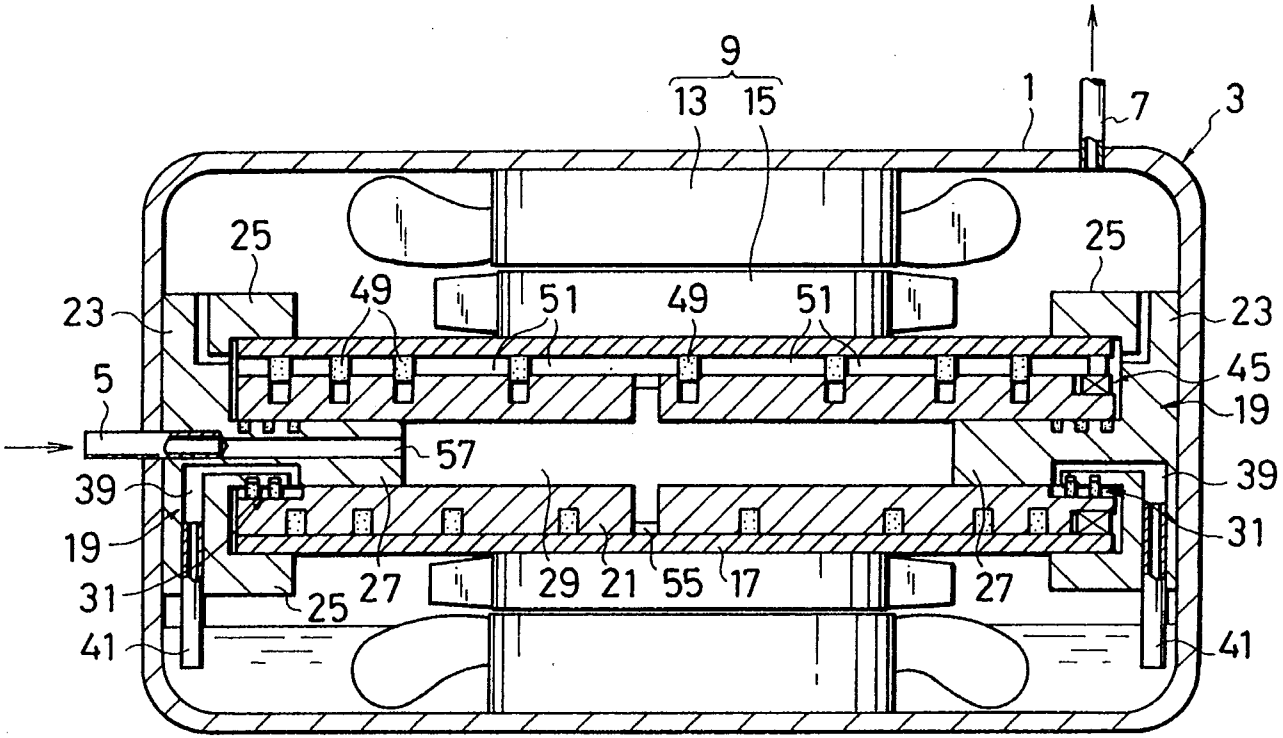
FIG. 9 shows a cross sectional view of a fluid compressor according to the second embodiment of the present invention.

With reference to FIG. 9, there is shown another preferred embodiment for the present invention.

In the same figure, the bearing portion 19 comprises the base portion 23 and the first and the second bearing members 25, 27. The second bearing member 27 is of a shaft-cylindrical shape projected from a central portion of the base portion 23 toward the inside, and both end openings of the rotary member 21 are freely rotatably supported thereby.

This embodiment is characterized in that the first bearing member 25 is projected such that it encloses the second bearing member 27 in a ring shape. In the inner circumferential surface of the second bearing member 27, both ends of the cylinder 17 is freely rotatably supported. Dimensions for both cylinder 17 and rotary member 21 are designed to be almost identical to each other's. Other parts used for this second embodiment are identical to one in the first embodiment and are given the same reference numerals as in the first embodiment.

Therefore, by implementing the above embodiment, both ends of the cylinder 17 are aligned with the both ends of the rotary member 21, so that the size and weight of the fluid compressor can be further reduced.

In above embodiments, the present invention is applied to the fluid compressor where the fluid is compressed toward the right- and left-side discharge portions from the central suction portion. However, the present invention may be implemented to a fluid compressor where the fluid is compressed toward a central discharge portion from right- and left-side suction portions so as to present the same beneficial effects on the above embodiments.

In summary, by employing the present invention, the bearing portion can support the rotary member in the vicinity of the load point on which the gas load force act, so that the deformation of the rotary member can be minimized. Therefore, the leakage in the operational chambers are suppressed to the minimum so as to significantly improve the performance and reliability of the fluid compressor.

Besides those already mentioned above, many modifications and variations of the above embodiments may be made without departing from the novel and advantageous features of the present invention. Accordingly, all such modifications and variations are intended to be included within the scope of the appended claims.

What is claimed is:

1. A fluid compressor housed in a casing, comprising:

a cylinder having an inner circumferential surface therein:

supporting means for rotatably supporting both ends of the cylinder;

a rotary member arranged in the cylinder so as to extend in the axial direction of the cylinder and be eccentric thereto, the rotary member having a spiral groove formed on an outer circumferential surface thereof, the spiral groove having pitches gradually narrowing with a distance from a suction-side end to a discharge-side end of the cylinder;

a spiral blade fitted in the spiral groove so as to be slidable in the radial direction of the rotary member: and drive means for rotating the cylinder and the rotary member, wherein the supporting means extends into the rotary member from a base portion fixed to the casing, and wherein there is provided a ring-shaped projected member for supporting the cylinder, serving as part of the supporting means, disposed around the cylinder, and projected toward the rotary member so that the eccentricity of the rotary member against the cylinder is maintained.

2. The fluid compressor of claim 1, wherein radial gas load forces are concentrated at a given distance from both ends of the rotary member and the projected member of the supporting means.

3. A twin helical fluid compressor housed in a casing, comprising:

a cylinder having an inner circumferential surface therein;

supporting means for rotatably supporting both ends of the cylinder;

a hollow rotary member arranged in the cylinder so as to extend in the axial direction of the cylinder and be eccentric thereto, the rotary member having a spiral groove being formed on an outer circumferential surface thereof;

the spiral groove having pitches gradually narrowing with a distance from a central portion of the rotary member to end portions of the cylinder;

a spiral blade fitted in the spiral groove so as to be slidable in the radial direction of the rotary member; and drive means for rotating the cylinder and the rotary member, wherein a portion of the supporting means extends into the hollow portion of the rotary member from a base portion fixed to the casing and wherein radial gas load forces are concentrated at a given distance from both ends of the rotary member and the portion of the supporting means which extends into the hollow portion of the rotary member ends in the vicinity of the gas load forces.

* * * * *